United States Patent [19]

Nemoto

[11] 4,124,783

[45] Nov. 7, 1978

[54] PHONOGRAPHIC PICKUP

[75] Inventor: Mitsuo Nemoto, Machida, Japan

[73] Assignee: Kabushiki Kaisha Audio-Technica, Tokyo, Japan

[21] Appl. No.: 783,403

[22] Filed: Mar. 31, 1977

[30] Foreign Application Priority Data

Dec. 21, 1976 [JP] Japan ..... 51-154458

[51] Int. Cl.[2] ..... H04R 9/16

[52] U.S. Cl. ..... 179/100.41 K; 179/100.41 D

[58] Field of Search ..... 179/100.41 K, 100.41 D, 179/100.41 Z, 100.41 M, 100.41 R

[56] References Cited

U.S. PATENT DOCUMENTS

| | | | |
|---|---|---|---|
| 2,114,471 | 4/1938 | Keller et al. | 179/100.41 K |
| 3,142,729 | 7/1964 | Davis | 179/100.41 K |
| 3,299,219 | 1/1967 | Madsen | 179/100.41 K |
| 3,679,843 | 7/1972 | Cho | 179/100.41 K |
| 3,720,796 | 3/1973 | Honma | 179/100.41 K |
| 3,729,596 | 4/1973 | Toth | 179/100.41 K |
| 3,761,647 | 9/1973 | Nemoto et al. | 179/100.41 K |

*Primary Examiner*—Raymond F. Cardillo, Jr.

[57] ABSTRACT

A transducer comprises a body including a permanent magnet having a pair of pole pieces which define a magnetic gap therebetween, and a stylus assembly including a pair of coils which are positioned within the magnetic gap. The stylus assembly comprises a cantilever arm having a stylus tip at one end, a non-magnetic carrier secured to the other end of the cantilever arm, a pair of armatures in the form of rods of a magnetic material and carried on the carrier, each of the armatures having one of the coils disposed thereon, and support means for mounting the cantilever arm and the carrier on the body in an oscillatable manner. The coils and the associated armatures are located on the opposite sides of a first imaginary vertical plane which includes the axis of the cantilever arm and lie in a second imaginary vertical plane which is perpendicular to the first plane. Each armature has an axis which is parallel to a modulation axis of a sound groove of a record disk, as projected onto the second plane so as to intersect the axis of the cantilever arm. The point of intersection between the axes of the armatures is spaced from the axis of the arm in the second vertical plane and lies in the first vertical plane. The pair of pole pieces are located on the opposite sides of the second vertical plane in a manner such that the flux passing through the magnetic gap is substantially perpendicular to the second vertical plane. The body is provided with output terminals, and the stylus assembly include lead wires on which voltages induced across the respective coils are produced, the lead wires being connected with the output terminals.

5 Claims, 4 Drawing Figures

PHONOGRAPHIC PICKUP

FIELD AND BACKGROUND OF THE INVENTION

The invention relates to a transducer for concurrently deriving a multichannel signal from a pair of modulation walls of a sound groove of a record disk, and more particularly to a transducer having a pair of moving coils which are located within the magnetic field established across a pair of pole pieces so as to correspond to the respective modulation walls of a sound groove.

British Pat. No. 1,000,035 discloses a transducer including a flat, square armature of a magnetic material around which a pair of moving coils are disposed in an orthogonal manner. With a transducer of this construction, since the coils share the armature, it is difficult to obtain high level of signal separation between the coils. Because the armature must carry the pair of coils, its volume is increased as is the radius around which the respective coils are disposed, with consequence that an oscillating system which comprises the armature and the pair of coils tends to have an increased value of mass. Hence, in order to reduce the equivalent mass, an arrangement must be employed such that most of the oscillating mass of the oscillating system be located on the center of oscillation. However, the resulting arrangement is considerably complex and requires a troublesome procedure for the manufacture and adjustment. Considering the dynamic aspect, the center of oscillation will undergo a slight displacement with the frequency of the oscillating system, so that the described arrangement is insufficient to achieve a reduction in the equivalent mass. As a consequence, the reproducible frequency range is limited in its high frequency region. A transducer of the type described is constructed such that the armature is mounted on the rear end of a cantilever arm and is supported together with the arm by a thin suspension rod with a damper of an elastic material disposed therebetween. However, because the rear surface of the armatures which is in contact with the damper is not flat as a result of the provision of the pair of coils thereon, the damping effect of the damper varies.

U.S. Pat. No. 3,679,843 proposes the use of an integral V-shaped armature having a pair of projections, instead of a square armature. Two sets of coils are disposed on each projection of the armature. In this design, although coils share a single armature as before, the volume of the armature can be decreased, individual coils can have a relatively greater number of turns, and a flat surface can be utilized for contact with the damper. However, as the projection of the armature is reduced in thickness, an undesirable resonance effect occurs as the stylus tip oscillates, thereby degrading the tone quality. For an industrial production of such transducer, it is necessary to use a press to form the V-shaped armature. However, the use of the press produces sharp edges or burrs, which may cause a short-circuiting of coils as the latter are disposed on the respective projections. Although it is possible to remove these sharp edges or burrs by a chemical treatment, this reduces the free end of the projections into a round form, reducing the length available for the disposition of a coil thereon. In addition, a difficulty is experienced during a coil winding operation since the armature cannot be rotated when winding a coil around each projection.

SUMMARY OF THE INVENTION

It is a general object of the invention to provide a transducer which completely eliminates above disadvantages of the prior art.

It is another object of the invention to provide a transducer having a pair of coils which are separately disposed on a pair of independent rod-shaped or cylindrical armatures.

In accordance with the invention, a transducer comprises a body including a permanent magnet having a pair of pole pieces which define a magnetic gap therebetween, and a stylus assembly including a pair of coils which are positioned within the magnetic gap. The stylus assembly comprises a cantilever arm having a stylus tip at one end, a non-magnetic carrier secured to the other end of the cantilever arm, a pair of armatures in the form of rods of a magnetic material and carried on the carrier, each of the armatures having one of the coils disposed thereon, and support means for mounting the cantilever arm and the carrier on the body in an oscillatable manner. The coils and the associated armatures are located on the opposite sides of a first imaginary vertical plane which includes the axis of the cantilever arm and lie in a second imaginary vertical plane which is perpendicular to the first plane. Each armature has an axis which is parallel to a modulation axis of a sound groove of a record disk, as projected onto the second plane so as to intersect the axis of the cantilever arm. The point of intersection between the axes of the armatures is spaced from the axis of the arm in the second vertical plane and lies in the first vertical plane. The pair of pole pieces are located on the opposite sides of the second vertical plane in a manner such that the flux passing through the magnetic gap is substantially perpendicular to the second vertical plane. The body is provided with output terminals, and the stylus assembly include lead wires on which voltages induced across the respective coils are produced, the lead wires being connected with the output terminals.

In accordance with the invention, as the coils positioned within the magnetic gap oscillate, the armatures located on their axes alternately induce a maximum flux within the coils. Since an interference between the armatures is eliminated, there is provided a transducer having a high level of signal separation between the coils.

According to the invention, a small armature can be used while allowing a coil having an increased number of turns to be disposed thereon. The combination of the armature and coil can be carried by a carrier having a reduced mass, thus reducing the equivalent mass at the stylus tip and providing a transducer having an increased reproducible frequency range.

The configuration of the armatures used in the invention is not limited to any shape. However, an armature having a cylindrical cross section is preferably used in consideration of disposing a coil thereon. This permits a number of armatures to be mounted on a row of spindles, which may be rotated to achieve a continuous winding. It will be also noted that a short-circuiting of the coil which occurred in the prior art as a result of penetration through the wire insulation is avoided.

BRIEF DESCRIPTION OF DRAWINGS

Above and other objects, features and advantages of the invention will become more apparent from the following detailed description of a specific embodiment thereof shown in the drawings, in which.

DETAILED DESCRIPTION OF PREFERRED EMBODIMENT

Figure 1:
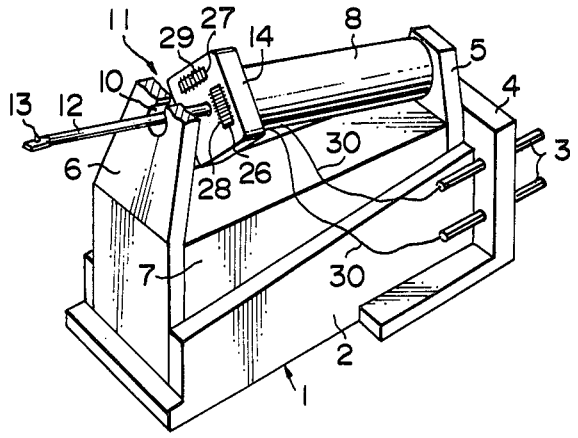
FIG. 1 is a perspective view, partly cut away, of the transducer according to the invention.

Referring to FIG. 1, there is shown a transducer according to the invention. The transducer comprises a body 1 including a casing 2 which is formed of a non-magnetic material. A terminal board 4 having a plurality of terminals 3 is attached to one end of the casing 2. A permanent magnet 7 having a pair of pole pieces 5, 6 is received within the casing 2. A cylindrical yoke 8 of a magnetic material is attached to one pole piece 5 and extends toward the other pole piece 6, and a magnetic gap 9 is defined between the free end of the yoke 8 and the other pole piece 6. As will be described later, the yoke 8 also serves as a support member of a stylus assembly 11, and a notch 10 is formed in the pole piece 6 for this purpose.

Figure 2:
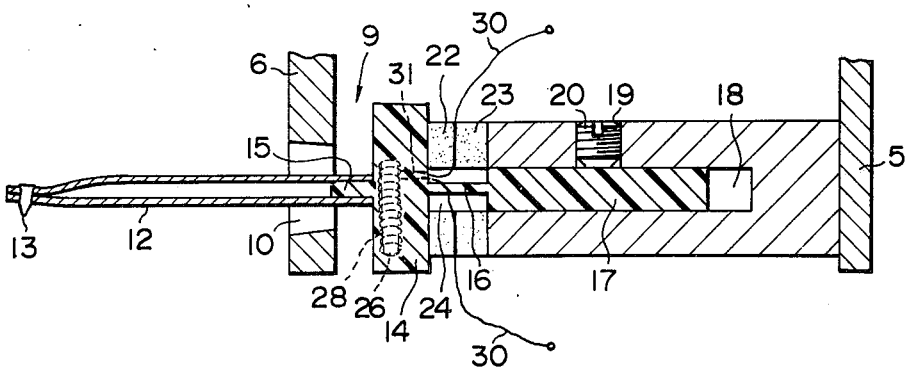
FIG. 2 is a longitudinal section of the stylus assembly shown in FIG. 1.

The stylus assembly 11 comprises a cantilever arm 12 extending through the notch 10. The arm has a stylus tip 13 at its one end which is located outside the pole piece 6, and is provided with a carrier 14 of a non-magnetic material at its other end which is disposed within the magnetic gap 9. The cantilever arm 12 comprises a tubular body formed of beryllium, titanium alloy or aluminium, while the carrier 14 may be cast molded from a synthetic resin such as nylon, for example. Referring to FIG. 2, it will be noted that the cantilever arm 12 and the carrier 14 are secured together by fitting the arm 12 over a projection 15 which projects forwardly from the carrier 14. However, these members may be secured together by any other suitable means such as providing a recess in the carrier 14 for receiving the end of the arm 12. On its rear surface which is remote from the arm 12, the carrier 14 is provided with a suspension rod 16 in alignment with the arm 12, and a mounting rod 17 is attached to the other end of the rod 16. The suspension rod 16 and mounting rod 17 may be integrally formed with the carrier 14, using the same material.

The yoke 8 of the body 1, which represents a support member for the stylus assembly 11 as mentioned above, is formed with an axial bore 18, in which the mounting rod 17 is received. The rod 17 is held in place within the bore 18 by a clamping bolt 20 which is screwed into a threaded bore 14 formed radially of the yoke 8. A pair of cylindrical dampers 22, 23 formed of an elastic material are disposed in coaxial relationship intermediate the carrier 14 and the front end face of the yoke 8, and each has a bore 24 in alignment with the axis thereof, through which the suspension rod 16 extends. The carrier 14 functions to apply a slight axial compression on the dampers 22, 23 against their resilience. At this end, the position of the mounting rod 17 within the bore 18 is determined by the bolt 20 such that it pulls the carrier 14 rearwardly or toward the yoke 8 through the suspension rod 16. In this manner, the suspension rod 16 is subject to a reaction of the compressed elastic dampers 22, 23 to restore, with consequence that a fulcrum for the oscillation of the cantilever arm 12 is established on the suspension rod 16.

Figure 3:
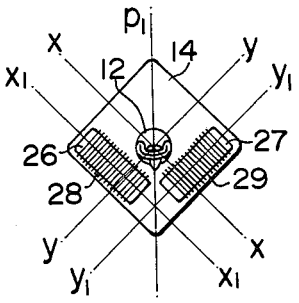
FIG. 3 is a front view of the stylus assembly, as viewed from the stylus tip.
Figure 4:
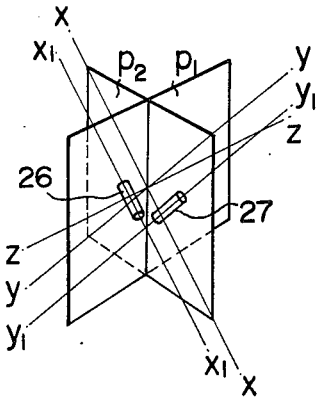
FIG. 4 is a diagrammatic view showing the positioning of the pair of coils and the pair of armatures.

In the transducer of the invention, a pair of armatures 26, 27 formed of a magnetic material are disposed within a pair of grooves formed in the front end face of the carrier 14. The armatures may have a cylindrical cross section. Coils 28, 29 are disposed on the respective armatures 26, 27. Each of the coils 28, 29 and each of the armatures 26, 27 are carried by the carrier 14 so as to assume a predetermined position within the magnetic gap 9. Referring to FIG. 4, it will be noted that the coils 28, 29 and the armatures 26, 27 are located on the opposite sides of a first imaginary vertical plane P1 which includes the axis Z—Z of the cantilever arm 12, and lie on a second imaginary vertical plane P2 which is orthogonal to the first vertical plane P1. The armatures 26, 27 have axes X1—X1 and Y1—Y1 which are each inclined at an angle of 45° with respect to the first vertical plane P1 and at right angle to each other. The point of intersection between the axes X1—X1 and Y1—Y1 is spaced from the axis Z—Z of the arm 12 in the second vertical plane P2 and lies in the first vertical plane P1. Thus, the axes X1—X1 and Y1—Y1 are parallel to modulation axes X—X and Y—Y of sound grooves of a record disk which are drawn to pass in the second vertical plane P2 and to intersect with the axis Z—Z of the arm 12. The second vertical plane P2 is orthogonal to a flux which passes through the magnetic gap 9. It will be understood that the modulation axes X—X and Y—Y represent a projection of modulation walls of a sound groove of a record disk. It will be seen from FIG. 3 that the pair of coils 28, 29 are disposed on the carrier 14 in orthogonal relationship with respect to each other, and their axes coincide with the axes X1—X1 and Y1—Y1. However, the coils and the armatures may be disposed on the carrier 14 such that their axes X1—X1 and Y1—Y1 are located above the modulation axes X—X and Y—Y, respectively, while maintaining a parallel relationship with the latter. To assure a faithful sound reproduction, it is preferred that the respective axes X1—X1 and Y1—Y1 are both at right angles with the axis Z—Z of the cantilever arm 12.

Each coil 28, 29 has lead wires 30, which are passed through a small opening 31 formed in the carrier 14 and into the bore 24 within the forwardly located damper 22. Subsequently, the lead wires are passed between the dampers 22, 23 to the exterior thereof for connection with the terminals 3 on the body 1. Passing the lead wires 30 between the pair of dampers 22, 23 prevents their self-resonance during the oscillation of the cantilever arm 12, and prevents an excessive displacement of the carrier 14 which might result from an impact applied to the stylus tip 13 from causing a breakage of the lead wires 30. A local distortion of the dampers 22, 23 which may be caused by passage of the lead wires 30 therebetween can be made negligibly small. When one of the dampers, 22, is formed of an elastic material which is more flexible than the material of the other damper 23, the fulcrum for the oscillation of the cantilever arm 12 can be shifted forwardly or toward the carrier 14 on the suspension rod 16. Suitable elastic materials include butyl rubber, neoprene rubber, silicone rubber or the like.

In this embodiment, the carrier 14, suspension rod 16 and mounting rod 17 are integrally molded from a synthetic resin material for the economy of manufacturing the stylus assembly. In this instance, the center of oscillation of the oscillating system is located on the suspension rod 16 intermediate the carrier 14 and the yoke 8. However, since the carrier 14 which supports the coils can be formed of a synthetic resin material having a substantially reduced mass than a magnetic material, and since the armatures 26, 27 carried by the carrier 14 have a reduced dimension, the equivalent mass of the oscillating system can be substantially reduced if the center of mass is slightly offset from the center of oscillation. It is to be noted however that most of the oscillating mass can be placed on the center of oscillation as taught in U.S. Pat. No. 3,720,796, assigned to the same assignee as that of the present application.

While not limitative, each of the cylindrical armatures 26, 27 may have an outer diameter of 0.4mm and a length of 1.5mm, using pure iron or 50% nickel Permalloy in a preferred form of the invention. While not limitative, each of the coils 28, 29 may be formed with an insulated aluminium wire or insulated aluminium-copper clad wire having a diameter on the order of 0.015 to 0.04mm. Preferably, the wire is directly wound around the respective armatures without using a bobbin. The coils 28, 29 may be completely embedded into the carrier 14 together with their associated armatures 26, 27.

Considering the operation of the transducer according to the invention, it is assumed that one of the walls of a sound groove is modulated while the other wall remains unmodulated. When the stylus tip 13 is disposed in the sound groove, it will be understood that said one modulating wall will cause a movement of the stylus tip 13 in a direction parallel to the modulation axes X—X. In this instance, the armature 26 having the axis X1—X1 parallel to the modulation axes X—X will oscillate in a manner such that its one end moves from one side of the second vertical plane P2 to the other side or simultaneously the other end moves alternately in the opposite direction. This results in an alternate passage of the flux through the armature 26, inducing a current flow through the coil 28 disposed thereon. It is to be noted that such motion of the stylus tip 13 only results in a movement of the other armature 27 in a direction parallel to the modulation axis Y, producing no current flow through the other coil 29 disposed thereon. When the modulated wall is interchanged, the other modulated wall causes a movement of the stylus tip 13 in a direction parallel to the modulation axis Y—Y, producing a current flow only in the coil 29. When the stylus tip 13 undergoes a composite motion, the resulting signals obtained from the respective coils assure a good signal separation.

Having described the invention, what is claimed is:

1. A phonograph pickup comprising a body including a permanent magnet having a pair of pole pieces which define a magnetic gap therebetween; and a stylus assembly including a pair of columnar armatures of a magnetic material which are positioned within the magnetic gap, the stylus assembly comprising a cantilever arm having a stylus tip at its one end, a carrier of a non-magnetic material secured to the other end of the arm and carrying the pair of armatures thereon, and support means for mounting the carrier together with the arm on the body in a manner to permit an oscillation thereof, said armatures being located on the opposite sides of a first imaginary vertical plane inlcuding the axis of the arm and lying on a second imaginary vertical plane which is perpendicular to the first vertical plane, the armatures having axes which are respectively parallel to and spaced apart from the modulation axes of a sound groove of a record disk said modulation axes being projected onto the second vertical plane in a manner to intersect with the axis of the arm, the pair of pole pices being located on the opposite sides of the second vertical plane so that a flux therefrom passes through the magnetic gap substantially perpendicular to the second vertical plane, the stylus assembly also comprising a pair of independent coils disposed on the pair of armatures and thus carried by the carrier, the coils having lead wires which are connected with output terminals provided on the body.

2. A pickup according to claim 1 in which the carrier is formed of a synthetic resin material and the pair of coils are embedded into the carrier together with the pair of armatures.

3. A pickup according to claim 1 in which the pair of armatures have a cylindrical cross section.

4. A pickup according to claim 1 in which said support means comprises a suspension rod extending from the carrier in a direction away from the arm in coaxial relationship with the arm, a screw for securing the rod to the body, a pair of tubular dampers of an elastic material which are disposed side by side between the carrier and the body, the lead wires extending from the respective coils through a hollow space within one of the dampers located nearer the stylus tip and being passed between the pair of dampers before being connected with the output terminals.

5. A pickup according to claim 4 in which said one damper is formed of an elastic material having an increased flexibility than the material of the other damper.

* * * * *